US009248683B2

(12) United States Patent
Kalwa et al.

(10) Patent No.: US 9,248,683 B2
(45) Date of Patent: Feb. 2, 2016

(54) METHOD FOR ADAPTING DÉCOR PRINTS AND A DEVICE FOR CONDUCTING SAID METHOD

(71) Applicant: Flooring Technologies Ltd., Pieta (MT)

(72) Inventors: Norbert Kalwa, Horn-Bad Meinberg (DE); Timo Skorzik, Gotha (DE)

(73) Assignee: Flooring Technologies Ltd., Pieta (MT)

( * ) Notice: Subject to any disclaimer, the term of this patent is extended or adjusted under 35 U.S.C. 154(b) by 0 days.

(21) Appl. No.: 14/835,273

(22) Filed: Aug. 25, 2015

(65) Prior Publication Data

US 2015/0360494 A1 Dec. 17, 2015

Related U.S. Application Data

(63) Continuation of application No. 14/508,384, filed on Oct. 7, 2014.

(30) Foreign Application Priority Data

Oct. 8, 2013 (EP) ..... 13187703

(51) Int. Cl.

| | |
|---|---|
| ***B41J 3/407*** | (2006.01) |
| ***B41M 5/00*** | (2006.01) |
| ***B41J 2/21*** | (2006.01) |

(52) U.S. Cl.

CPC ..... *B41M 5/0076* (2013.01); *B41J 2/21* (2013.01); *B41J 3/407* (2013.01); *B41M 5/0041* (2013.01); *B41M 5/0047* (2013.01)

(58) Field of Classification Search

CPC combination set(s) only.
See application file for complete search history.

(56) References Cited

U.S. PATENT DOCUMENTS

| | | | |
|---|---|---|---|
| 2010/0208058 | A1 | 8/2010 | Massen |
| 2011/0311806 | A1 | 12/2011 | Meersseman et al. |
| 2013/0240137 | A1 | 9/2013 | Kalwa |
| 2014/0017452 | A1 | 1/2014 | Pervan et al. |
| 2014/0255670 | A1 | 9/2014 | Kalwa |

FOREIGN PATENT DOCUMENTS

| | | | |
|---|---|---|---|
| EP | 2452829 | A1 | 5/2012 |
| EP | 2636531 | A1 | 9/2013 |
| KR | 200370449 | Y1 | 12/2004 |

*Primary Examiner* — Huan Tran
(74) *Attorney, Agent, or Firm* — The Webb Law Firm

(57) ABSTRACT

The present invention relates to a method for printing wood-based boards, in particular, wood-fiber boards, by means of a digital printing process. The method includes the steps of: a) measuring the color value of the wood-based board of at least one first batch and transmitting the color values to a computer program; b) measuring of the color values of the wood-based board of at least one further batch and transmitting the color values to the computer program; c) processing the color values of the wood-based board of the at least one further batch in the computer program and adapting the color value of the digital print; and d) printing at least one side of the wood-based board by means of digital printing technique by forming a décor layer such that no color deviations between the printed decors of the wood-based boards of the at least one first batch and each further batch occur.

24 Claims, No Drawings

METHOD FOR ADAPTING DÉCOR PRINTS AND A DEVICE FOR CONDUCTING SAID METHOD

CROSS-REFERENCE TO A RELATED APPLICATION

This application is a continuation application of U.S. application Ser. No. 14/508,384, filed Oct. 7, 2014, which claims priority to European Patent Application No. 13 187 703.7 filed Oct. 8, 2013, the disclosures of which are each incorporated herein by reference in their entirety.

BACKGROUND OF THE INVENTION

1. Field of the Invention

The present invention relates to a method for adapting décor prints and a device for conducting said method.

2. Description of Related Art

Substrate materials, as for instance wood-based boards, provided with a décor are typically used as floor covering or for cladding walls and ceilings. In the past, the wood-based boards used a substrate materials were often coated with a décor paper for this purpose, wherein the multiplicity of different patterned décor papers was or is not limited.

As an alternative to the use of décor papers on wood-based boards in the past the direct printing of wood-based boards as substrate materials has been developed since the printing of paper and the subsequent lamination or direct coating thereof onto the wood-based board is dispensed with.

The printing techniques primarily used in this case are the gravure printing method and the digital printing method. The gravure printing method is a printing technique in which the elements to be depicted are present as depressions in a printing form, which is inked before the printing. The printing ink is primarily located in the depressions and is transferred to the object to be printed such as, for instance, as substrate material on the basis of contact pressure of a printing form and of adhesive forces. In case of digital printing on the other hand, the printing image is transferred directly from a computer into a printing machine such as, for instance, a laser printer or inkjet printer. The user of a static printing form is dispensed with.

In the context of the technical development of the printing technology of different substrate materials it is, however, more and more focused on digital printing. While digital printing methods were used at first especially in the graphic industry as for instance advertisement agencies, advertising media or in shops, it appears in the meantime that digital printing methods are also met more frequently in other sectors of industry. There are, indeed, multiple reasons, wherein, however, two main arguments can be identified. The digital printing allows the production of a printing image with in a particular high quality due to a higher resolution and allows further a broader application spectrum with high flexibility.

Digital printing is conducted today most exclusively using the color system CYMK. The CYMK color model is a subtractive color model, wherein the abbreviation CYMK stands for the three color ingredients cyan, magenta, yellow and the black portion Key as color depth. Using this color system, a color space (Gamut) can be imaged which suffices the many requirements from different areas.

Furthermore, products shall become cheaper by mass production on one hand, and on the other hand the customer expects a larger variety, which is reflected for instance in an almost endless décor variety. A tremendous problem is thereby a prediction, which a manufacturer, for instance, of decorative surfaces for consumer goods, such as laminate floors has to make regarding the questions, which decors are accepted by the customer and which not.

When redesigning a collection, a manufacturer of decorative boards has to buy a minimum quantity of printed décor paper or printed finish films. The minimum quantity of paper is typically in the range of about 1 ton, what corresponds to about 15,000 $m^2$. This décor paper has then to be impregnated, to be pressed on substrate boards and to be further processed. In case that exactly this décor is not successful at the market, residual quantities are created on all levels of value creation, which cannot be used anymore. The economic damage arising therefrom is considerably. Furthermore, the coloring of the décor was at least determined for the one ton of paper.

A possibility to solve this problem would be the production of all decors exclusively by means of digital printing. This has, however, the serious disadvantage that these decors are considerably more expensive in respect to the printing costs. Furthermore, the higher quality level of the decors due to the higher resolution of the digital printing could devaluate other non-digital printed decors and could thus cause sales loss of conventionally printed substrate materials.

A further increasing trend exists in lot-sizes which become constantly smaller. The digital printing technology can take this trend in general into account. Due to the high flexibility of the digital print, it is not only possible to print paper or firm sheets, but also directly substrate boards as, for instance, wood-fiber boards. Hereby some levels of value creation can be skipped in this way of further refining to semi-finished or final products, as, for instance, furniture boards, laminate floors or cladding boards, what provides a further flexibilization and simplification of the production processes.

In particular in the wood-based industry until now almost exclusively decorative surfaces have been generated using the indirect gravure printing on décor papers and had thereby to fight with increasing problems of batch sizes.

Digital printing offers a solution here. It is at the moment propagated almost exclusively, as is the indirect gravure printing, on décor paper or on pre-impregnates, as for instance, pre-resined papers. Thereby, inks on water basis are mostly used, which after printing and subsequent drying still have a certain water solubility. Since in the subsequent production of the decorative surfaces at least in case of décor papers an impregnation with water-soluble resins has to be carried out, followed by pressing in a short-cycle press, the high resolution is partially deteriorated or destroyed by dissolving the colors.

The direct printing on a substrate board, preferably a wood-based board, pre-primed if necessary, by means of digital printing would be thus a desirable solution.

When realizing the solution, however, multiple obstacles have to be overcome.

The décor papers used for indirect gravure printing have a good opacity due to their relative high pigment load. In this way the intrinsic color of the substrate shall be eliminated as far as possible. In an alternative, a primer can be applied directly onto a substrate board. When a primer is applied directly onto a substrate board, preferably a wood-based board, the primer on the substrate board should not be done too thick since otherwise the protective layers, preferably synthetic resins, applied later on, cannot penetrate the primer and thus delamination or bubbles can occur after a pressing in the short-cycle press.

On the other hand, the primer can also not be done too thin. Then, the danger exists that the substrate is not completely covered, what has a negative influence on the overall color of the décor.

A further problem is that singular batches of substrate materials can be subjected to fluctuations in the composition, what can cause differences in brightness and/or the color of the substrate board. Visible differences, in particular color deviations, between the singular product-batches can occur after printing the décor.

SUMMARY OF THE INVENTION

A technical object of the present invention was therefore to offer a method for adapting décor prints on substrate materials.

According to the invention a method for producing décor prints with the same quality on substrate materials is provided, the brightness and/or color thereof is subjected to fluctuations, wherein a constant quality, in particular color, of the décor prints independent on the fluctuations in the brightness and/or the color of the substrate materials is obtained.

Color deviations in the printing motive of the decors printed by means of digital printing occur in the production process in particular after changing from one batch of the substrate material to a new batch of the substrate material. Color deviations can also occur between singular or multiple substrate boards of the same batch of the substrate material.

For correcting color deviations between the substrate boards of different batches of the substrate material, at first the color values of the substrate boards of at least one first batch of the substrate material are continuously measured and transmitted to a computer program. When changing the batch of the substrate material, the color values of the substrate boards of at least one further batch of the substrate material are continuously measured and are also transmitted to a computer program. The color values of the substrate boards of the at least one first batch and the at least one further batch of the substrate material are processed by the computer program. In case color deviations between the substrate boards of the at least one first batch and at least one further batch of the substrate material, the color values of the digital print for the decors of the at least one further batch and/or of the at least one first batch of the substrate material are adapted. Thereby it is guaranteed that no color deviations between the printed decors of the at least one first batch of the substrate material and each further batch of the substrate material occur.

The substrate material used in the present method can be selected from a group containing paper, glass, metal, films, and wood material, in particular MDF- or HDF-boards, veneer, varnish, plastic boards and inorganic substrate boards, as for instance cement-chip boards, cement fiber boards and plaster fiber boards.

Wood-based boards, in particular wood-fiber boards are preferably used.

Thus, according to an exemplary embodiment of the invention, a method for printing wood-based boards, in particular of wood-fiber boards, by means of a digital printing method is provided, comprising the steps a) measuring the color values of the wood-based boards of at least one first batch and transmitting the color values to a computer program;
b) measuring the color values of the wood-based boards of at least one further batch and transmitting the color values to the computer program;
c) processing the color values of the wood-based board of the at least one first batch and the at least one further batch by the computer program and adapting the color values of the digital print for the at least one first batch and/or at least one further batch;
d) printing at least one side of the wood-based board by means of digital printing technique by forming a décor layer such that no color deviations between the printed decors of the wood-based boards of the at least one first batch and each further batch occur.

The same proceedings can be used if color deviations between singular boards within a batch of substrate material, preferably of wood-based boards, occur.

The method according to an exemplary embodiment of the invention comprises then the steps:

a) measuring of the color values between at least one first wood-based board and transmitting the color values to a computer program;
b) measuring of the color values of at least one further wood-based board and transmitting the color values to the computer program;
c) processing the color values of the at least one first wood-based board and the at least one further wood-based board by the computer program and adapting the color values of the digital print for the at least one first wood-based board and/or at least one further wood-based board;
d) printing at least one side of the wood-based board by means of digital printing technique by forming a décor layer such that only tolerable color deviations between the printed decors of the at least one first wood-based board and each further wood-based board occur.

The measurement of the color values in the method according to the invention occurs preferably continuously.

DESCRIPTION OF THE INVENTION

In an exemplary embodiment of the present method at least one primer layer comprising at least one resin and/or at least one varnish is applied to the side of the wood-based board to be printed before printing, which is subsequently predried and/or precured.

The side of the wood-based board to be printed is preferably sanded before applying the primer.

An aqueous resin solution and/or a radiation curable putty can be applied to the side of the substrate material to be printed for priming. As primer means, for instance, aqueous resin solutions such melamine-formaldehyde resin, urea-formaldehyde resin or melamine-urea-formaldehyde resin are usable. It is also possible to pre-coat or prime the substrate material with 1K/2K acrylate, UV and/or ESH primer and subsequently to cure this primer layers accordingly.

For pre-coating or priming of the wood-based board, an aqueous resin solution is preferably used, which is an aqueous resin solution, in particular an aqueous solution of a melamine-formaldehyde resin, a urea-formaldehyde resin or melamine-urea-formaldehyde resin.

The applied quantity of liquid resin solution for priming can be between 10 and 80 g/m$^2$, preferably 20 and 50 g/m$^2$. The solid content of the aqueous resin solution is between 30 and 80%, preferably 40 and 60%, in particular preferably at 55%. The liquid resin can comprise additionally suitable wetting agents, hardener, release agents and defoamer.

After applying the aqueous resin solution to the wood-based board for pre-coating or priming the same, the liquid resin is dried to a moisture of 10%, in particular 6% for instance in a convection oven or near-infrared oven.

In another exemplary embodiment of the present method the wood-based board can be pre-coated or primed with 1K/2K acrylate- and/or ESH-primer. A UV-putty consists preferably essentially of UV curable lacquer, pigments, reactive diluents and radical formers as chain starter.

The applied quantity of the putty can be in this case 50 to 150 g/m$^2$, preferably 50 to 100 g/m$^2$. The indication of quantity relates thereby to a 100% putty.

It is also possible that the putty used for priming is pigmented, thereby the printing result varies or can be improved.

The pre-coating of the wood-based board with a transparent primer is in particular preferred according to the invention.

In a further exemplary embodiment of the present invention at least one layer of a pigmented primer, which is preferably water-based, is applied to the side of the wood-based board to be printed before printing the at least one side of the wood-based board. The pigmented primer can be applied either directly to the non-treated surface of the wood board or also to the prior preferably transparent primer.

The water-based pigmented primer can also be applied in more than one layer (for instance 3 to 10 layers, preferably 5 to 8 layer, in particular preferably 7 layers), whereby after each layer application, the pigmented primer is dried for instance in a convection dryer or a near-infrared dryer. The water-based pigmented primer contains preferably at least one pigment of a bright color, in particular preferably at least one white pigment.

White pigments are achromatic inorganic pigments with a high refractive index (larger than 1.8), which are especially used for obtaining optical white in coating agents or as filler in, for instance, plastics. White pigments according to the invention can be selected from a group comprising titanium dioxide, lithopone, barium sulfate, zinc oxide, zinc sulfide and calcium sulfate. Lithopone is a white pigment that contains barium sulfate and zinc sulfide.

The method according to the invention is in particular environmentally friendly, since no compounds are used as white pigments which contain toxic heavy metals.

According to the invention, titanium dioxide is preferably used as white pigment in the water-based pigmented primer, since titanium dioxide has the highest refractive index and thus the highest opacity amongst the known white pigments.

The color distance ($\Delta E$) is used for determining color deviations. The color distance ($\Delta E$) provides the differences between two colors. From a mathematical point the color distance is the shortest connection between two color locations present in the CIE color room (DIN 5033-2, 1992). A color location can be assigned to each color by means of a standard color chart and color measuring system. If the color distance is known, a clear statement can be made how strongly two colors differ from each other. The color distance can be determined with conventional physical methods. However, the reception of color difference by human is the main factor.

The method according to the invention is preferably conducted such that only tolerable color deviations between the printed decors of the wood-based board of the at least one first batch and each further batch or the at least one first wood-based board and each further wood-based board occur.

According to the present invention, color deviations between the printed decors of the wood-based boards of the at least one first batch and each further batch or the at least one first wood-based board and each further wood-based board are then tolerable if the color distance ($\Delta E$) is not perceived as different or is only very small. The color deviations are preferably in a range, which is not perceived by human. In a further preferred embodiment, the method according to the invention is conducted accordingly such that no color deviations between the printed décors of the wood-based board of the at least one first batch and each further batch, or of the at least one first wood-based board and each further wood-based board occur.

Color deviations, which are perceived by a human at least clearly or strongly, are not tolerable according to the invention.

Color deviations can be, for instance, determined by the uniformity method. In this method, the investigated pattern is compared by a technical device or visually by eye with a series of known standard patterns so long until uniformity can be determined for certain. It is also possible to offer the selected base colors proportionally. Technical applications are the color circle or the approach by Maxwell. In the first case, the temporal resolution of a measuring device or the eye is fallen below by a fast change, in the second case, a spatial distribution of the base colors is delivered to an apparent common surface by non-focusing and thus a unified color impression is perceived by the eye. This method uses typically the uniformity judgment of the normal eye side.

In a preferred embodiment, the method according to the invention comprises the steps:

a) applying a primer to wood-based boards of at least one first batch and at least one further batch,
b) applying a pigmented primer to the wood-based board of the at least one first batch and the at least one further batch,
c) measuring the color values of the wood-based boards of the at least one first batch and transmitting the color values to a computer program;
d) measuring the color values of the wood-based board of the at least one further batch and transmitting the color values to the computer program;
e) processing the color values of the wood-based board of the at least one first batch and the at least one further batch by the computer program and adapting the color values of the digital print for the at least one first batch and/or at least one further batch;
f) printing at least one side of the wood-based board by means of digital printing technique by forming a décor layer such that no color deviations between the printed décor of the wood-based board of the at least one first batch and each further batch occur.

According to an exemplary embodiment, the method according to the invention can comprise the continuous measurement of brightness of the substrate board coated with the preferably water-based pigmented primer.

Depending on the detected brightness, the applied quantity of the water-based pigmented primer, which preferably contains titanium dioxide as white pigment, can then be adapted in order to maintain a mostly unified brightness level of the substrate material. The adaptation of the applied quantity can be carried out either automatically by a control unit, as for instance a control computer, or a process computer, or manually.

The color and brightness measurement can be conducted by conventional color measuring devices. The color and brightness measurement is preferably carried out by an online color measuring device.

However, often not only the brightness of the substrate boards, but also their color changes between the singular batches of the substrate materials. Due to rollers, which are only adjustable in a relative inaccurate manner, in the application units for the primers of the substrate boards, the adjustment of an accurate applied quantity of the water-based pigmented print color is only possible to a limited extent and causes an oscillation about the desired brightness value. Furthermore, an influence of the color of the substrate boards by the primer containing the white pigments is only possible to a limited extent.

This problem is being solved by a continuous color measurement of pre-primed bright, preferably white, substrate boards for determining the color values and the subsequent processing and use of the gained color data for adapting the color values of the décor print. During color measurement the L*, a* and b* values in the so-called L*a*b* color space are preferably determined.

The L*a*b* color space is a color space which covers the range of the perceivable colors. The L*a*b* color space is described by a three-dimensional coordinate system. The L* axis describes the brightness (luminescence) of the color with values from 0 (black) to 100 (white). The a* axis describes the green or red percentage of a color, wherein negative values stand for green, and positive value stand for red. The b* axis describes the blue or yellow percentage of a color, wherein negative values stand for blue and positive values stand for yellow. The scales of the a* axis and the b* axis comprise a number range −150 to +100 and −100 to +150.

In the method according to the invention, the value for the brightness L* should be at least >50, >60 or >70. Preferably L* is >80. In an particular preferred embodiment is L*>85 or >90.

In the method according to the invention, the values for a* and/or b* are in a range between −100 and +100, −80 and +80, −60 and +60, −40 and +40 or −20 and +20. The values for a* and/or b* are preferably in a range between −10 and +10. In a preferred embodiment, the values for a* and/or b* are in a range between −5 and +5. In a particular preferred embodiment of the invention, the values for a* and/or b* are almost zero.

The color measurement is conducted by means of a conventional color measuring device, preferably by means of an online color measuring device. Subsequently, the profiling of the color data of the pre-primed substrate board is conducted by processing the L*, a* and b* values determined by the continuous measurement by a computer program. A so-called RIP software is preferably used as computer program.

RIP (Raster Imaging Process) software is a software for calculating color values. In the method according to the invention, when adapting the color data by means of the RIP software considering the brightness and/or color of the primer, a conversion of the measured color values into the standard color systems CYMK for the digital printing is carried out.

Adaptation of the color values for the digital printing means that the percentages of the singular components of the CYMK standard color system are changed. Preferably, the percentages of the singular components of the CYMK standard color system are changed such that by considering the detected brightness or the detected color values of the substrate board after the décor printing, no color deviations between the printed decors of the substrate boards of the at least one first batch and each further batch occur.

In a further embodiment, the method according to the invention comprises optionally quality control of the colors of the décors after digital printing. During said quality control it is tested if color deviations in the décor occur between the substrate boards of a substrate material provided with the printed decors. This can take place, for instance, by visual control.

Different decors, for instance such as wood, tile, phantasy decors or parquet imitations can be typically used as printing motives for the digital printing.

In digital printing, a water-based digital printing ink is preferably used to print the at least one side of the wood-based board. The digital printing can be carried out by using a digital printer with a water-based digital printing ink, a UV- or solvent-based ink. The use of water-based digital printing ink is preferred. The quantity of digital printing ink can be between 5 and 15 g/m$^2$, preferably 6 and 8 g/m$^2$.

According to a further embodiment, the present method provides a protective layer on a digital printed wood-based board which is arranged at the same time as mediator, so-called primer, between non-compatible layers, such as décor print or décor layer on the one hand and a following wear protection or other finishing layers on the other hand.

At present, either a resin, preferably a water compatible resin, a radiation curable, typically non-water compatible varnish, for instance, selected from the group of acrylates, modified acrylates and/or epoxide, or also polyurethane, which have good adhesive properties, can be directly applied onto the digital print. After pre-hardening or pre-gelling of the protective layer, an intermediate storage of the printed boards is possible without danger of the surface damage or contamination of the décor layer. Thus, even in case of a non-defined time period between a processing step digital décor printing and a further processing step, no problems such as contamination of boards or abrasion and/or detachment of the décor is to be expected. Thus, it is also guaranteed that in case of an interruption of operations in the processing, the digital printer does not have to be stalled.

In an exemplary embodiment, the protective layer to be applied to the décor layer of the wood-based board comprises at least one water compatible resin, preferably a formaldehyde containing resin, in particular preferably melamine-formaldehyde resin, urea-formaldehyde resin and/or melamine-urea-formaldehyde resin. Accordingly, the resin can be applied in liquid form or else in solid form, the use of a liquid resin being preferred.

Next, the protective layer comprising the at least one water compatible resin is predried until the resin is still free flowing and cross-linkable. The predrying of the protective layer containing a water comparable resin is typically carried out in a continuous drying oven, such as is known from wood-based board production. Depending on the applied quantity, the drying process can last for 5 to 15 seconds, preferably 5 to 10 seconds.

If a radiation curable varnish is used as protective layer, the pre-gelling of the protective layer following the application of the protective layer can be carried out by using UV-radiation (e.g. at 320-400 nm), EB-radiation and/or NIR-radiation. Following the pre-gelling, the varnish preferably has a degree of polymerization between 20-60%, preferably 30-50%.

In a further reaching variant of the present method, the protective layer be applied to the printed side of the wood-based board is applied in a quantity between 5 and 50 g/m$^2$, preferably 8 and 30 g/m$^2$, in particular preferably 10 and 20 g/m$^2$.

It is likewise possible to apply at least one protective layer to the décor or the decors, in particular a layer comprising abrasion-resistant particles, natural fibers, synthetic fibers and/or further additives, wherein resins such as melamine-formaldehyde-resin, or urea-formaldehyde-resin, acrylate resins and polyurethane resins can be used as suitable binder.

In a further exemplary embodiment of the method according to the invention, multiple protective layers are applied to the décor or decors, which can comprise different additives.

In a preferred embodiment, the method according to the invention comprises thus the steps:

applying a first resin layer, which contains abrasion-resistant particles, to the side of the wood-based board provided with the décor, drying the first resin layer to a residual moisture of 3% to 6%, and/or applying a second resin layer to the side of the wood-based board provided with the décor, which contains fibers, drying the second resin layer to residual moisture of 3% to 6%, and/or applying at least one third resin layer, which contains glass particles, to the side of the wood-based board provided with the décor, drying the third resin layer to a residual moisture of 3% to 6%; and pressing the layer structure under pressure and temperature influence for forming a laminate.

The abrasion-resistant particles are preferably chosen from the group containing aluminum oxide, corundum, boron carbide, silicon dioxide, silicon carbide and glass particles. Suitable for use as natural and/or synthetic fibers are in particular fibers chosen from the group containing wood fibers, cellulose fibers, wool fibers, hemp fibers and organic or inorganic polymer fibers.

As additives, conductive substances, flame-prevention agents, luminescent substances and metals can be added. Thereby the conductive substances can be chosen from the group containing carbon black, carbon fibers, metal powders and nanoparticles, in particular carbon nanotubes. It is also possible for combinations of these substances to be used. The flame prevention agents used are preferably phosphates, borates, in particular ammonium polyphosphate, tris(tri-bromoneopentyl)phosphate, zinc borate or borate acid complexes of multivalent alcohols. Luminescent substances are preferably fluorescent and/or phosphorescent substances on an inorganic or organic basis, in particular zinc sulfide and alkaline earth aluminates.

Corundum particles are preferably contained in the first resin layer for improving the abrasion resistance. This is in particular of importance for the use as flooring panel in order to withstand the high stress which a flooring panel is exposed to. A mixture of typically silanised corundum of different granulation can be, for instance, used as corundum. The corundum can be simply added to the resin before application.

Cellulose fibers are preferably used as fibers in the second resin layer. Customary fibers can be used thereto, which also can be added to the resin layers to be applied.

The glass particles contained in the third resin layer are, for instance, customary micro glass balls. Said balls can also simply be added to the resin layer to be applied.

The third resin layer contains preferably a percentage of 20% glass particles. About 5% cellulose has been shown to be of an advantage for the second resin layer. The first resin layer contains in particular 20% corundum particles.

In a further embodiment of the method according to the invention one or multiple resin layers can also be applied to the lower side of the wood-based board. Thereby traction forces caused by the resin layers applied to the upper side of the wood-based board are in particular compensated. In a particular preferred embodiment the respective resin layers applied to the upper and lower side are applied in the same quantity or the back pull applied to the lower side of the wood-based board corresponds exactly to the layer construction and the respective layer thickness to the layer order applied to the upper side.

The resin layers applied to the lower side of the wood-based board can be colored.

Additives such as hardener, wetting and release agents can be added to all resin layers.

The resin layers on the upper and the lower side of the wood-based board can contain a 60% synthetic resin solution.

Drying to a residual moisture of 3% to 6% serves to prevent the linking process of the applied resin layers.

In a further embodiment of the present method the substrate material printed and optionally provided with one or multiple protective layers is processed further or finished in a short-cycle press. In the short-cycle press the resin layers melt again under pressure and temperature influence. The linking process is thus continued. The singular resin layers are thus not only linked within itself but also among each other. As a result the applied melamine resins can be linked by including the décor and can be hardened to a laminate. Typical short-cycle presses work, for instance, at a pressure of 30 to 60 kg/cm$^2$, a temperature on the wood-based board surface of about 165° C. and a press time of 6 to 12 seconds.

During the further processing in the short-cycle press surface structures can also be produced in at least one surface, preferably at least the upper side of the substrate material such as a wood-based board by using a structured press plate, which optionally can be implemented in a manner such that it is adapted to the decor (so-called decor synchronous structures). The surface structures are preferably designed congruent to the décor as much as possible. In this case one talks about embossed-in-register structures. In the case of wooden decors the structures can be present in the form of pore structures which follow the grain. In the case of tile decors, the structures can be depressions in the area of joined filling lines comprised by the décor.

In a particular preferred embodiment, the method according to the invention comprises the steps:

a) applying a primer to the wood-based board of at least one first batch and at least one further batch, b) applying a pigmented primer to the wood-based board of the at least one first batch and the at least one further batch, c) measuring the color values of the wood-based boards of at least one first batch and transmitting the color values to a computer program;

d) measuring the color values of the wood-based boards of at least one further batch and transmitting the color values to the computer program;

e) processing the color values of the wood-based boards of the at least one first batch and/or the at least one further batch by the computer program and adapting the color values of the digital print;

f) printing at least one side of the wood-based boards by means of digital printing technique by forming a décor layer such that no color deviations between the printed decors of the wood-based boards of the at least one first batch and each further batch occur;

g) applying at least one protective layer containing at least one resin, at least one radiation curable varnish and/or at least one polyurethane to the décor layer; and h) pre-drying and/or pre-gelling of the protective layer applied to the décor layer;

and optionally i) quality control of the colors of the décor after the digital print.

The present method is carried out in a device for adapting décor prints on substrate materials of at least one first batch and at least one further batch, wherein the device comprises the following elements:

at least one means for measuring the color values of the substrate material, at least one means for adapting the color data, at least one printing line with at least one digital printer for printing at least one side of the substrate material by means of digital printing technique by forming a décor layer such that no color deviations between the printed decors of the substrate material of the at least one first batch and each further batch occur.

In a further variant, the present device comprises at least one means or a device for applying a primer to the substrate material.

In a preferred variant, the device according to the invention comprises at least one means or a device for applying a pigmented primer, which is preferably water-based, to the substrate material.

In a further preferred embodiment, the device comprises at least one means for measuring the brightness of the substrate material coated with the pigmented primer, which is preferably water-based.

The means or devices for applying the primer and/or the pigmented primer and the measuring of the brightness of the substrate material are preferably arranged in front of the at least one means for measuring the color values of the substrate material, i.e. the L*a*b*-color values.

In a further variant, the present device comprises at least one means for applying at least one protective layer to the substrate material provided with a respective printing décor. Said means or device for applying a protective layer is preferably arranged subsequently to the at least one printing line.

The device contains preferably multiple means for applying multiple protective layers to the substrate material provided with the respective printing décor. In a particular preferred embodiment, the device contains two, three or four means for applying two, three or four protective layers to the substrate material provided with the respective printed décor.

The device according to the invention can also comprise additionally one or multiple means for applying one or multiple resin layers to the lower side of the substrate material. If the upper and the lower side of the substrate material shall be provided with protective layers, the means for applying the protective layers can be constructed, for instance, as double applying devices.

In a further embodiment, the present device comprises at least one means for measuring the color values of the substrate material provided with the printed décor for quality control.

In a preferred embodiment, the present device has at least one short-cycle press for pressing the substrate material provided with the printed décor and the protective layer arranged thereon.

The presently described method has the advantage that a fast supply of color adapted products is possible, which show no significant color deviations despite color variations of the substrate material or of the primer of the substrate material. Even smallest color variations of the substrate material or of the primer of the substrate material can be directly detected in the process and can be corrected. The presently described method is in so far a self-regulating system. The method provides furthermore a cost reduction in the production process by minimizing the production of defective products or of products with undesired color deviations in the décor generated by means of digital printing, since the color deviations of the substrate material or of the primer of the substrate material are already taken into account before printing and the digital print is therefore carried out already with adapted and optimized color values.

The present invention provides furthermore a wood-based board, preferably a wood-fiber board, obtained by the method according to the invention.

The invention is subsequently explained in more detail with reference by means of an example.

Example

A batch of HDF-boards (batch I) is processed in the production, which is to be provided with a digital print. The process sequence is thereby the following:

Separating the HDF-boards from a pile, sanding the HDF-boards on the upper side, applying a transparent primer consisting of melamine resin, drying the primer, applying a primer pigmented with titanium dioxide with in-between drying (up to 7 times), color measurement with transmitting the data to RIP software, digital print with adapted color data, applying a transport protection consisting of melamine resin, drying.

Batch I had the following color values after the priming with titanium dioxide containing primer:

| Batch I, L*a*b*-values: | |
|---|---|
| Measurement 1 | 88.51/−0.66/−0.75 |
| Measurement 2 | 86.54/−0.57/−0.54 |
| Measurement 3 | 87.30/−0.63/−0.67 |
| Average: | 87.45/−0.62/−0.65 |

These color values were used for profiling the primer by the RIP software and provided the following color values when printing a decor to the board:

| L*a*b*-color of the decor of boards of batch I: | |
|---|---|
| Dark color: | 60/10.5/11.7 |
| Intermediate color: | 73.2/6.0/25.8 |
| Bright color: | 79.5/4.0/23.8 |

Subsequently, a new batch of HDF-boards (batch II) was processed which had the following color values after priming:

| Batch II, L*a*b*-values: | |
|---|---|
| Measurement 1 | 89.11/−0.79/−0.90 |
| Measurement 2 | 88.19/−0.69/−0.74 |
| Measurement 3 | 88.37/−0.63/−0.75 |
| Average: | 88.68/−0.70/−0.80 |

After the print no visible difference, i.e. a color deviation, could be detected between the print on the boards of batch I and on the boards of batch II. This happened although the color values of the primed boards did not deviate very strongly from each other. In order to correct the color deviation, the color values of the boards of batch II were processed by the RIP software and the digital print was conducted with the following color values:

| L*a*b*-values of the decor after adapting batch II: | |
|---|---|
| Dark color: | 60/10.5/11.7 |
| Intermediate color: | 73.5/6.0/25.8 |
| Bright color: | 79.7/4.0/23.8 |

When comparing the decors of batch I and the decors of batch II, no significant color deviation was detectable.

The boards of batch I and batch II were subsequently coated on the printed side with a first layer of melamine resin, which contained 20% corundum particles, and subsequently dried in a drying oven to a residual moisture of 4%.

Subsequently, all boards were coated on the printed side with a second layer of melamine resin, which contained 5% cellulose fibers, and were dried subsequently in a drying oven to a residual moisture of 4%.

Subsequently, all boards were coated on the printed side with a third melamine resins, which contained 20% micro glass balls, and which were also dried in a drying oven to a residual moisture of 4%.

Finally, the hardening of the three melamine resins to a laminate took place in a short-cycle press at a pressure of 50 kg/cm$^2$, a temperature on the wood-based surface of about 165° C. and a pressing time of 10 sec.

The decors of the boards of the batch I and batch II were compared after each coating step and after pressing in the short-cycle press. Thereby no significant color deviations could be detected after the application of the singular melamine resins and also after passing the short-cycle press.

The invention claimed is:

1. A method for printing wood-based boards, in particular wood-fiber boards, by means of a digital printing process, comprising the steps:

a) continuous measurements of the color values of the wood-based boards of at least one first batch and transmitting the color values to a computer program;

b) continuous measurements of the color values of the wood-based boards of at least one further batch and transmitting the color values to the computer program;

c) processing the color values of the wood-based boards of the at least one first batch and the at least one further batch by the computer program and continuous adaptation of the color values of the digital print for the at least one first batch and/or at least one further batch;

d) printing at least one side of the wood-based board by means of digital printing technique by forming a printed décor as a décor layer such that no color deviations between the printed decors of the wood-based boards of the at least one first batch and each further batch occur.

2. The method according to claim 1, wherein at least one primer layer comprising at least one resin and/or at least one varnish is applied to the side of the wood-based board to be printed before printing, which is subsequently predried and/or precured.

3. The method according to claim 2, wherein for priming an aqueous resin solution and/or a radiation-curable putty is applied to the side of the wood-based board to be printed.

4. The method according to claim 1, wherein before printing the at least one side of the wood-based board at least one layer of a pigmented primer is applied to the side of the wood-based board to be printed.

5. The method according to claim 4, wherein the applied quantity of the pigmented primer, which contains preferably at least one white pigment, is adapted in order to obtain a rather uniform brightness level of the substrate material.

6. The method according to claim 1, wherein a water-based, UV-based or solvent-based digital printing ink is used for printing the at least one side of the wood-based board.

7. The method according to claim 1, wherein after printing at least one protective layer is applied onto the décor layer of the wood-based board, which comprises at least one water-compatible resin, preferably a formaldehyde containing resin, in particular preferably melamine-formaldehyde resin, urea-formaldehyde resin and/or melamine-urea-formaldehyde resin.

8. The method according to claim 1, wherein the at least one protective layer to be applied onto the décor layer of the wood-based board comprises at least one radiation-curable varnish selected from the group of acrylates, modified acrylates and/or epoxide, or at least one polyurethane selected from the group containing aliphatic urethanes or a mixture of at least one radiation-curable varnish and at least one polyurethane.

9. The method according to claim 1, wherein multiple protective layers of a water compatible resin are applied onto the décor layer of the wood-based board after printing, further comprising the steps:

applying a first resin layer, which contains abrasion resistant particles, drying the first resin layer to a residual moisture of 3% to 6%, and/or applying a second resin layer, which contains fibers, drying the second resin layer to a residual moisture of 3% to 6%, and/or applying at least a third resin layer, which contains glass particles, drying the third resin layer to a residual moisture of 3% to 6%; and pressing the layer structure under pressure and temperature influence in a short-cycle press for forming a laminate;

wherein the pressing of the layer structure in the short-cycle press is performed at least on the upper side of the laminate optionally with simultaneous formation of a structure, which is preferably adapted to the décor of the wood-based board.

10. A device for generating décor prints of same quality on substrate materials of at least one first batch and/or at least one further batch, wherein the device comprises the following elements:

at least one means for measuring the color values of the substrate material continuously, at least one means for adapting the color data, at least one printing line with at least one digital printer for printing at least one side of the substrate material by means of digital printing technique by forming a printed décor as a décor layer such that no color deviations between the printed decors of the substrate material of the at least one first batch and/or each further batch occur.

11. The device according to claim 10, further comprising at least one means for applying a primer to the substrate material.

12. The device according to claim 10, further comprising at least one means for applying a pigmented primer.

13. The device according to claim 10, further comprising at least one means for measuring the brightness of the substrate material continuously after applying a pigmented primer.

14. The device according to claim 10, further comprising at least one means for applying a protective layer to the substrate material provided with a respective printing décor.

15. The device according to claim 10, further comprising at least one short-cycle press for pressing the substrate material provided with the décor and the protective layer arranged thereon.

16. A method for printing wood-based boards, in particular wood-fiber boards, by means of a digital printing process, wherein the method is applied to one batch of wood-based boards, comprising the steps:

a) continuous measurements of the color values of at least one first wood-based board and transmitting the color values to a computer program;

b) continuous measurements of the color values of at least one further wood-based board continuously and transmitting the color values to the computer program;

c) processing the color values of the at least one first wood-based board and the at least one further wood-based board by the computer program and continuous adaptation of the color values of the digital print continuously for the at least one first wood-based board and/or at least one further wood-based board;

d) printing at least one side of the wood-based boards by means of digital printing technique by forming a printed décor as a décor layer such that no color deviations between the printed decors of the at least one first wood-based board and each further wood-based board occur.

17. The method according to claim 16, wherein at least one primer layer comprising at least one resin and/or at least one varnish is applied to the side of the wood-based board to be printed before printing, which is subsequently predried and/or precured.

18. The method according to claim 17, wherein for priming an aqueous resin solution and/or a radiation-curable priming material is applied to the side of the wood-based board to be printed.

19. The method according to claim 16, wherein before printing the at least one side of the wood-based board at least one layer of a pigmented primer is applied to the side of the wood-based board to be printed.

20. The method according to claim 19, wherein the applied quantity of the pigmented primer, which contains preferably at least one white pigment, is adapted in order to obtain a rather uniform brightness level of the substrate material.

21. The method according to claim 16, wherein a water-based, UV-based or solvent-based digital printing ink is used for printing the at least one side of the wood-based board.

22. The method according to claim 16, wherein after printing at least one protective layer is applied onto the décor layer of the wood-based board, which comprises at least one water-compatible resin, preferably a formaldehyde containing resin, in particular preferably melamine-formaldehyde resin, urea-formaldehyde resin and/or melamine-urea-formaldehyde resin.

23. The method according to claim 16, wherein the at least one protective layer to be applied onto the décor layer of the wood-based board comprises at least one radiation-curable varnish selected from the group of acrylates, modified acrylates and/or epoxide, or at least one polyurethane selected from the group containing aliphatic urethanes or a mixture of at least one radiation-curable varnish and at least one polyurethane.

24. The method according to claim 16, wherein multiple protective layers of a water compatible resin are applied onto the décor layer of the wood-based board after printing, further comprising the steps:

applying a first resin layer, which contains abrasion resistant particles, drying the first resin layer to a residual moisture of 3% to 6%, and/or applying a second resin layer, which contains fibers, drying the second resin layer to a residual moisture of 3% to 6%, and/or applying at least a third resin layer, which contains glass particles, drying the third resin layer to a residual moisture of 3% to 6%; and pressing the layer structure under pressure and temperature influence in a short-cycle press for forming a laminate; and wherein the pressing of the layer structure in the short-cycle press is performed at least on the upper side of the laminate optionally with simultaneous formation of a structure, which is preferably adapted to the décor of the wood-based board.

* * * * *